US005184608A

United States Patent [19]

Hale, III

[11] Patent Number: 5,184,608

[45] Date of Patent: Feb. 9, 1993

[54] WELL PIPE TOP CAP

[76] Inventor: Ernest E. Hale, III, 54 The Downs, Tuscaloosa, Ala. 35401

[21] Appl. No.: 675,872

[22] Filed: Mar. 27, 1991

[51] Int. Cl.[5] ..... F16L 55/10

[52] U.S. Cl. ..... 138/89; 138/90; 138/96 R; 166/92; 166/93; 166/97

[58] Field of Search ..... 138/89, 90, 96 R; 166/92-94, 97; 220/241

[56] References Cited

U.S. PATENT DOCUMENTS

| | | | |
|---|---|---|---|
| 1,479,193 | 1/1924 | McSpadden | 138/96 R |
| 2,032,686 | 3/1936 | Cohen | 138/96 R |
| 2,179,191 | 11/1939 | McWilliams | 138/89 |
| 2,522,444 | 9/1950 | Grable | 166/93 |
| 2,799,476 | 7/1957 | Bielstein | 166/93 |
| 3,625,282 | 12/1971 | Bridges et al. | 166/92 |
| 4,848,458 | 7/1989 | Holdsworth et al. | 138/89 |
| 4,895,205 | 1/1990 | Thompson et al. | 166/92 |

*Primary Examiner*—James E. Bryant, III
*Attorney, Agent, or Firm*—Warren H. Kintzinger

[57] ABSTRACT

A well pipe top enclosing pipe cap is provided that has two pivotally interconnected half cylindrical concave pipe end enclosing halves pivotal from an open state to a closed state. The half cylindrical concave halves made of iron, or steel, have half circle enclosing tops and inwardly extended projections at the bottoms that come into upward motion limiting engagement with the bottom of the well pipe top end boss holding the well pipe cap in place in the closed state. In the closed and locked state a cylindrical lock element on one cylindrical concave pipe end enclosing half is mounted for being in alignment with and between two cylindrical lock elements on the other pipe end enclosing half, and an "L" shaped lock rod element is inserted through the aligned lock elements. The top branch of the lock rod element is lowered into a "U" shaped bracket welded in place on the top of one of the half circle enclosing tops and a padlock is locked in place with a portion of its hasp loop extended through aligned openings in opposite sides of the "U" shaped bracket. A lifting handle is welded on the top of the other semicircle enclosure top.

13 Claims, 2 Drawing Sheets

WELL PIPE TOP CAP

Figure 1:
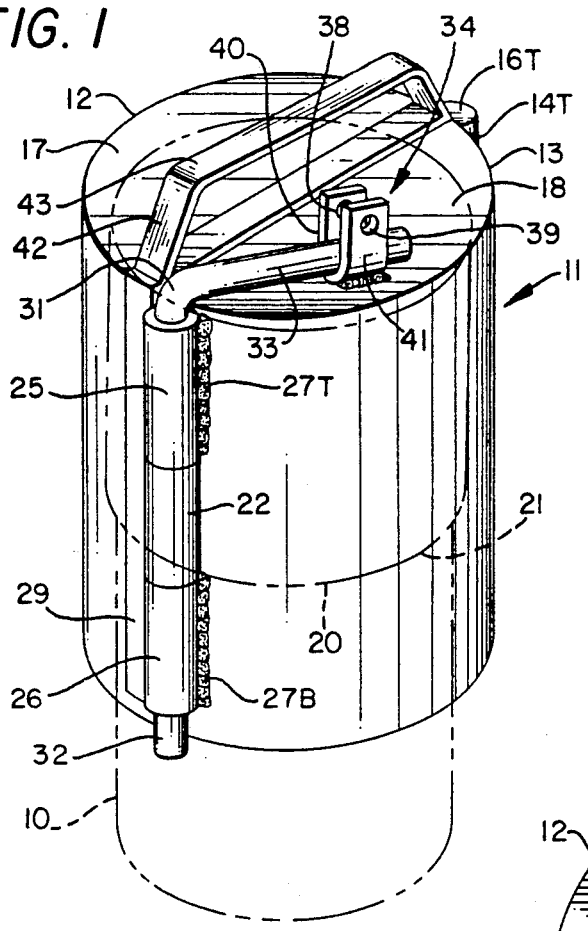

This invention relates in general to well top enclosure protection, and more particularly, to a well pipe cap placeable on and lockable in a closed state enclosing the enlarged annular boss top end of a well pipe whether it be the pipe of an oil and/or gas well or water well.

Most oil and gas wells and many water wells have an upper end enlarged increased diameter internally threaded end into which continuation piping and/or instrumentation may be threaded. During periods of well inactivity such continuation piping, instrumentation and control equipment is many times removed leaving the well top open vulnerable to destructive action by vandals throwing debris and various foreign matter into the well. Thus, it is important to so close the well top as to prevent free access thereto by those who have no right of access and to prevent tampering by trespassers and damage by vandals.

It is therefore a principal object of this invention to provide a locked in place secure enclosure for the top end of an oil well and/or gas well or water well pipe.

Another object is to provide a well pipe top end enclosure protecting the well from acts of trespassers and vandals.

A further object is to provide a well pipe top end enclosure preventing entry of animals to the pipe opening and entry of leaves or other vegetation to the pipe interior.

Still another object is to provide such a well pipe top end enclosure easily removable by unlocking and removing a padlock and lifting a position lock rod readily reinstallable on other well pipe tops.

Features of the invention useful in accomplishing the above objects include, in a well pipe top cap, a pipe cap having two pivotally interconnected half cylindrical concave pipe end enclosing halves pivotal from an open state to a closed state. The half cylindrical concave halves made of iron, or steel, have half circle enclosing tops and inwardly extended projections at the bottoms that come into upward motion limiting engagement with the bottom of the well pipe top end boss holding the well pipe cap in place in the closed state. In the closed and locked state a cylindrical lock element on one cylindrical concave pipe end enclosing half is mounted for being in alignment with and between two cylindrical lock elements on the other pipe end enclosing half, and an "L" shaped lock rod element is inserted through the aligned lock elements. The top branch of the lock rod element is lowered into a "U" shaped bracket welded in place on the top of one of the half circle enclosing tops and a padlock is locked in place with a portion of its hasp loop extended through aligned openings in opposite sides of the "U" shaped bracket. A lifting handle is welded on the top of the other semicircle enclosure top.

A specific embodiment representing what is presently regarded as the best mode of carrying out the invention is illustrated in the accompanying drawings.

Figure 2:
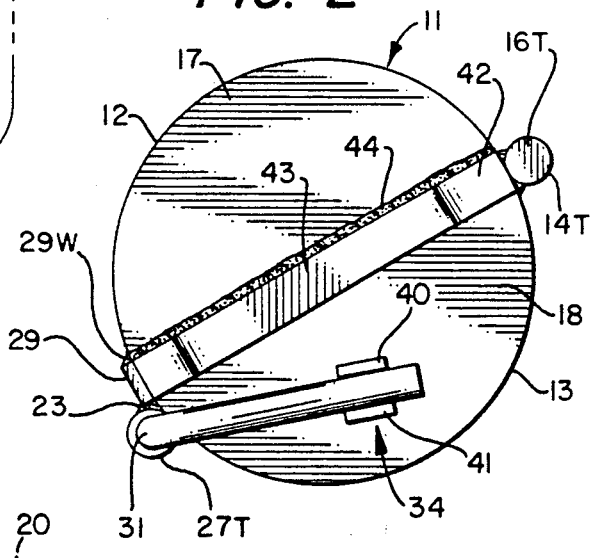
Figure 3:
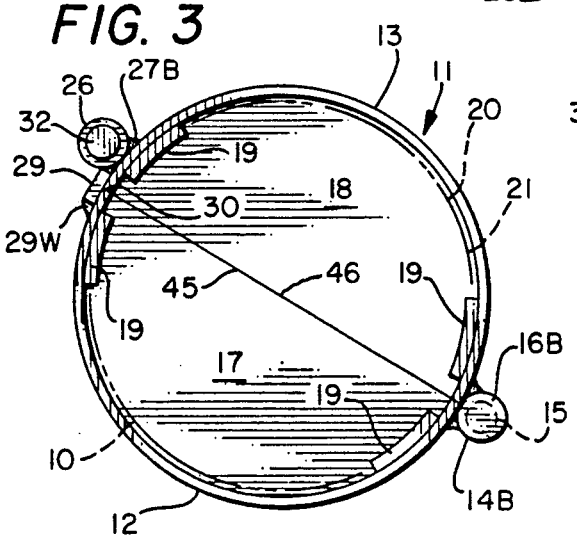
Figure 4:
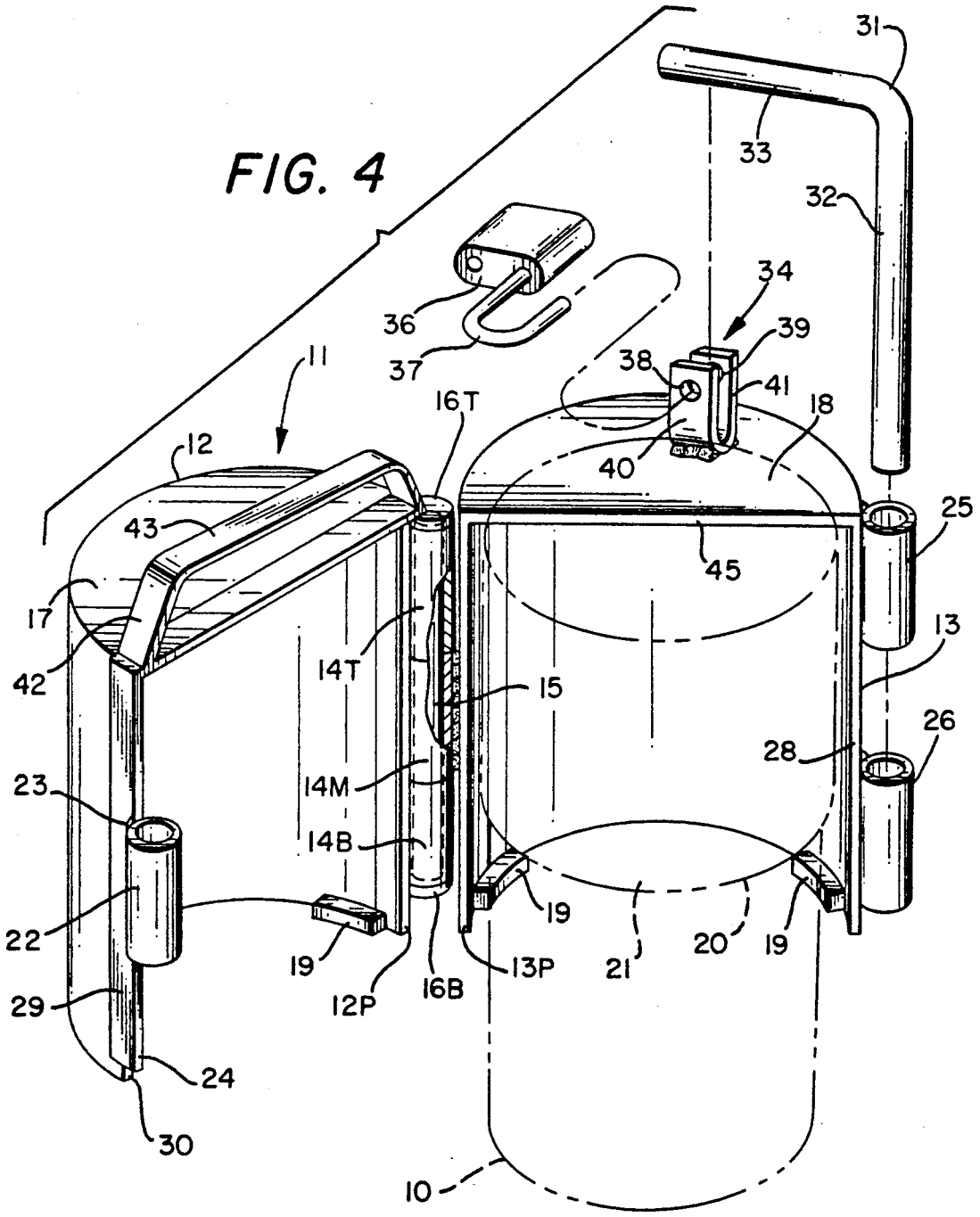

In the drawings:

FIG. 1 represents a perspective view of a well pipe top cap in the closed lock state enclosing the top end annular boss of a well pipe top end (indicated in phantom);

FIG. 2, a top plan view of the well pipe top cap in the closed and locked state of FIG. 1;

FIG. 3, a bottom plan view of the well pip top cap in the closed and locked state of FIGS. 1 and 2; and, FIG. 4, a perspective view of the well pipe top cap in the open unlocked state for installation on, or removal from, the top annular boss end of a well pipe with the closed lock position "L" shaped lock rod element in the raised state.

Referring to the drawings:

A well pipe 10 top cap 11 is shown to include two half cylindrical concave halves 12 and 13 pivotally interconnected together. This is at pivot edges 12P and 13P by cylindrical pivot elements 14T and 14B welded to cylindrical half 12 and 14M welded to cylindrical half 13 and a pivot rod 15 held within the elements 14T, 14B and 14M by weldment enclosure 16T at the top and 16B at the bottom in elements 14T and 14B, respectively. The half cylindrical concave halves 12 and 13 are made of a strong hard metal such as iron or steel, and have half circle (semi-circle) enclosure tops 17 and 18, respectively, and inwardly extended projections 19, two at the bottom inside of each of the half cylindrical concave halves 12 and 13 that extend inwardly far enough to engage the bottom 20 of well pipe 10 top annular boss 21 if the well top cap 11 is raised when in the closed and locked state.

In the closed state cylindrical lock element 22 welded 23 on cylindrical concave pipe end enclosing half 12 at edge 24 of vertical side overlay strap 29 is mounted to be positioned between and in alignment with two cylindrical lock elements 25 and 26 mounted by top and bottom weldments 27T and 27B to the outside of pipe end enclosing half 13 adjacent side edge 28. Overlay strap 29 is welded 29W to the outer side of enclosing half 12 overlying half edge 30 that comes into close adjacency if not abutment with edge 28 of enclosing half 13. "L" shaped lock rod element 31 has the vertical rod portion 32 thereof that is insertable through the aligned lock elements 22, 25 and 26. The top branch 33 of the lock rod element 31 is lowered into an upstanding "U" shaped bracket 34 fastened in placed on the top of the half circle enclosing top 18 of cylindrical half 13 by weldment 35. A padlock 36 is locked in place with a portion of its hasp loop 37 extended through aligned openings 38 and 39 in opposite sides 40 and 41 of the "U" shaped bracket 34. A lifting handle 42 with a cross strap 43 is fastened by weldment 44 on the top of cylindrical half 12 top 17 with the cross strap 43 in right angles alignment with overlay strap 29 and overlaying enclosure top 18 inner closure edge 45 and, in the closed state, also overlying inner closure edge 46 of enclosure top 17.

A typical well pipe top cap 11 is made to fit a five and one half inch outer diameter well pipe 10 having a top annular boss 21 with an outer diameter of six inches and extending down six and seven eighths of an inch from the well pipe top. With this pipe top cap 11 the semi-circle tops 17 and 18 are one half inch thick, the half cylindrical concave halves 12 and 13 have one quarter inch thick walls with the inwardly extended projections having an inner surface diameter of five and five eights inches and being vertically one quarter inch thick. The height of the pipe top cap from the top of the semi-circle tops to the bottom of half cylindrical concave halves 12 and 13 is ten and five eights inches long. Obviously, in other well pipe top caps the dimensions would vary accordingly with pipe top dimensions.

Whereas this invention has been described with respect to a single embodiment thereof, it should be realized that various changes may be made without departure from the essential contributions to the art made by the teachings hereof.

I claim:

1. A well pipe cap for well pipe tops having an enlarged top end annular boss comprising: a pipe cap having first and second half cylindrical concave halves; pivotal means interconnecting said first and second half cylindrical concave halves with the halves pivotal from an open state to a closed state enclosing a well pipe top end annular boss; said first and second half cylindrical concave halves including inwardly extended projection means at the bottom that comes into upward motion limiting engagement with the bottom of the well pipe top end annular boss as said well pipe cap is being lifted; lock means for locking said first and second half cylindrical concave halves in the closed state; wherein said inwardly extended projection means at the bottom include a plurality of inwardly extended projections fastened to the bottom of the inner walls of said first and secodn half cylindrical halves; said first and second half cylinder concave halves are each provided with a half circle enclosure top; and wherein a side edge of one of said first and second half cylinder concave halves is behind a vertically extended overlay strap welded to one of said first and second half cylinder concave halves.

2. The well pipe cap of claim 1, wherein a cross overlay strap is welded to the top of one of said half circle enclosure tops overlying the inner closure edge of the top it is welded to, and with the well pipe cap in the closed state also overlying the inner closure edge of the other enclosure top.

3. The well pipe cap of claim 2, with said cross overlay strap in right angles alignment with said vertically overlay strap.

4. The well pipe cap of claim 3, wherein said pivotal means interconnecting said first and second half cylinder concave halves is a piano type hinge with cylindrical pivot elements welded to respective half cylindrical concave halves and enclosing a pivot rod.

5. The well pipe cap of claim 4, wherein the closed and locked state, a first tubular lock element is fastened to said first half cylindrical concave half; second tubular lock elements are fastened to said second half cylindrical concave half; a rod is positioned through said first and second tubular lock elements, of said first and second half cylindrical concave halves, in an aligned state; and lock means locking said rod in position extending through said first and second tubular lock elements in an aligned state.

6. The well pipe cap of claim 5, wherein said lock means includes a padlock with a hasp loop connected for holding said rod in position extending through said aligned first and second tubular lock elements of said first and second half cylindrical concave halves.

7. The well pipe cap of claim 6, wherein said rod is an "L" shaped rod having a right angle rod extension at the top.

8. The well pipe cap of claim 7, wherein an upstanding "U" shaped bracket is welded to the top of one of said half circle enclosure tops and has aligned openings in opposite sides of the "U" shaped bracket; said rod extension lowerable into said upstanding "U" shaped bracket; and said padlock hasp loop having a portion extendable through said aligned openings and over said rod extension when lowered into said upstanding "U" shaped bracket.

9. The well pipe cap of claim 8, wherein said first tubular lock element fastened to said first half cylinder concave half is a single tubular element welded in place to be in alignment with and between said second tubular lock elements including, a top tubular lock element and a bottom tubular lock element welded in place to said second half cylinder concave half.

10. The well pipe cap of claim 1, wherein in the closed and locked state first tubular lock element is fastened to said first half cylindrical concave half; second tubular lock elements fastened to said second half cylindrical concave half; a rod is positioned extending through said first and second tubular lock elements, of said first and second half cylindrical concave halves, in an aligned state; and lock means locking said rod in position extending through said first and second tubular lock elements in an aligned state.

11. The well pipe cap of claim 10, wherein said lock means includes a padlock with its hasp loop connected for holding said rod in position extending through said aligned first and second tubular lock elements of said first and second half cylindrical concave halves.

12. The well pipe cap of claim 11, wherein said rod is an "L" shaped rod having a right angle rod extension at the top.

13. The well pipe cap of claim 12, wherein an upstanding "U" shaped bracket is welded to the top of one of said half circle enclosure tops and has aligned openings in opposite sides of the "U" shaped bracket; said rod extension lowerable into said upstanding "U" shaped bracket; and said padlock hasp loop having a portion extendable through said aligned openings and over said rod extension when lowered into said upstanding "U" shaped bracket.

* * * * *